US007637072B2

(12) United States Patent
Parish

(10) Patent No.: US 7,637,072 B2
(45) Date of Patent: Dec. 29, 2009

(54) DEVICE, SYSTEM, AND METHOD OF HOLDING REBAR IN A SUBSTANTIALLY FIXED POSITION IN A SURFACE

(76) Inventor: Warren E Parish, 578 S. 50 East, Burley, ID (US) 83318

( * ) Notice: Subject to any disclaimer, the term of this patent is extended or adjusted under 35 U.S.C. 154(b) by 0 days.

(21) Appl. No.: 12/101,060

(22) Filed: Apr. 10, 2008

(65) Prior Publication Data

US 2008/0184664 A1 Aug. 7, 2008

Related U.S. Application Data

(62) Division of application No. 10/986,245, filed on Nov. 10, 2004, now Pat. No. 7,549,261.

(51) Int. Cl.
*E04B 1/00* (2006.01)

(52) U.S. Cl. ..... 52/742.1; 52/742.14

(58) Field of Classification Search ..... 52/633, 52/677, 679, 681, 687, 689, 583.1, 741.15, 52/295, 297, 699, 712, 703, 704, 706, 293.3, 52/719, 170; 411/522, 523, 520, 529
See application file for complete search history.

(56) References Cited

U.S. PATENT DOCUMENTS 1,102,350 A * 7/1914 Myers ..... 24/11 CT
1,350,603 A * 8/1920 Gerritson et al. ..... 249/18
1,495,659 A * 5/1924 Williamson ..... 52/677

(Continued)

FOREIGN PATENT DOCUMENTS

DE 3520493 A1 * 12/1985

(Continued)

*Primary Examiner*—Richard E Chilcot, Jr.
*Assistant Examiner*—Charissa Ahmad
(74) *Attorney, Agent, or Firm*—Advantia Law Group; Michael W. Starkweather; Jason P. Webb

(57) ABSTRACT

A device, system, and method for holding reinforcing bars in fixed positions. A reinforcing bar securing device comprises a base and a securing means for securing the reinforcing bar to the base, which is configured to engage at least one rib of the reinforcing bar. The securing means may include a flange, a hinged member, or a flexible member, such as plastic, for example, configured to allow the reinforcing bar to enter the securing means in one direction and engage at least one rib on the reinforcing bar to prevent the reinforcing bar from withdrawing from the securing means. The flanges are configured to bend to press against the reinforcing bar as the ribs contact the flanges and as the reinforcing bar moves relative to the securing device as the reinforcing bar enters the surface. A system of the present invention is also presented for holding reinforcing bars in fixed positions. The system, in one embodiment, includes a first securing device for holding a first reinforcing bar in a fixed position in the surface and a second securing device for holding a second reinforcing bar at a predetermined position along the length of the first reinforcing bar. The second securing device may be configured with a lip to hold the second reinforcing bar proximate to the first reinforcing bar. A method of the present invention is also presented for holding a reinforcing bar in a fixed position in the surface using the reinforcing bar securing device.

6 Claims, 11 Drawing Sheets

U.S. PATENT DOCUMENTS 1,672,852 A * 6/1928 Roughan ..... 52/677
1,937,197 A * 11/1933 Halladay ..... 293/102
2,169,181 A * 8/1939 Kost ..... 411/520
2,264,489 A * 12/1941 Tiegler et al. ..... 248/694
RE22,544 E * 9/1944 Tinnerman ..... 411/522
2,358,890 A * 9/1944 Tinnerman ..... 411/529
2,511,829 A * 6/1950 Arrighini et al. ..... 249/175
2,560,518 A * 7/1951 Amesbury ..... 411/523
2,574,107 A * 11/1951 Joy ..... 411/529
3,057,034 A * 10/1962 Helmick ..... 249/213
3,239,988 A * 3/1966 Meyer ..... 52/718.04
3,315,937 A * 4/1967 Eriksson ..... 249/44
3,376,612 A * 4/1968 Munse ..... 411/523
3,456,550 A * 7/1969 Meyer ..... 411/529
3,636,593 A * 1/1972 Buttriss et al. ..... 24/294
3,693,310 A * 9/1972 Middleton ..... 52/685
3,694,989 A 10/1972 Oliver et al.
3,736,719 A * 6/1973 Wise ..... 52/677
3,771,884 A * 11/1973 Williams ..... 403/188
3,809,350 A * 5/1974 Lane ..... 248/57
3,869,760 A * 3/1975 Meyer ..... 24/562
3,933,332 A * 1/1976 Lovisa et al. ..... 249/42
4,178,661 A * 12/1979 Klein ..... 24/130
4,267,995 A * 5/1981 McMillan ..... 248/74.1
4,281,439 A * 8/1981 Klein ..... 24/130
4,388,791 A * 6/1983 Anderson ..... 52/719
D272,125 S 1/1984 Van Doren
4,505,006 A * 3/1985 Andre ..... 24/16 PB
4,575,985 A * 3/1986 Eckenrodt ..... 52/677
4,597,702 A * 7/1986 Brown ..... 411/529
4,644,610 A * 2/1987 Fish ..... 24/30.5 S
4,655,023 A 4/1987 Yung
4,697,312 A * 10/1987 Freyer ..... 24/30.5 S
4,726,560 A * 2/1988 Dotson ..... 249/43
4,736,554 A * 4/1988 Tyler ..... 52/105
4,800,702 A * 1/1989 Wheeler ..... 52/677
4,866,903 A * 9/1989 Ferstay ..... 52/677
4,883,397 A * 11/1989 Dubost ..... 411/174
4,925,350 A * 5/1990 Kolseth ..... 411/82
5,050,365 A * 9/1991 Edgar et al. ..... 52/713
5,060,436 A * 10/1991 Delgado, Jr. ..... 52/295
5,086,662 A * 2/1992 Tayon et al. ..... 74/501.5 R
5,351,456 A * 10/1994 Paine, Jr. ..... 52/426
5,365,715 A * 11/1994 Steinmetz et al. ..... 52/848
5,456,051 A * 10/1995 Queen et al. ..... 52/677
5,532,669 A * 7/1996 Tsunezawa et al. ..... 338/184
5,581,868 A * 12/1996 Bisch ..... 29/525.08
5,628,161 A * 5/1997 Giannuzzi et al. ..... 52/698
5,640,743 A * 6/1997 Greene et al. ..... 24/10 R
5,664,389 A * 9/1997 Williams ..... 52/677
5,670,076 A * 9/1997 Leek ..... 249/53 M
D392,547 S * 3/1998 Nakamura ..... D8/356
5,794,394 A * 8/1998 Bill et al. ..... 52/295
D398,836 S * 9/1998 Kalat ..... D8/370
5,833,422 A * 11/1998 Haga et al. ..... 411/526
6,065,730 A * 5/2000 Marks et al. ..... 248/314
6,176,061 B1 * 1/2001 Smith ..... 52/719
6,385,938 B1 * 5/2002 Gavin ..... 52/677
6,431,517 B1 * 8/2002 Chapman ..... 249/93
6,508,447 B1 * 1/2003 Catani et al. ..... 248/300
6,536,172 B1 * 3/2003 Amend ..... 52/426
6,640,517 B2 * 11/2003 Mitchell ..... 52/298
D484,784 S * 1/2004 Siragusa ..... D8/396
6,679,299 B1 * 1/2004 Hitchin ..... 140/57
6,789,364 B2 * 9/2004 Popovich et al. ..... 52/506.01
7,017,866 B2 * 3/2006 Whorton ..... 248/71
7,216,837 B2 * 5/2007 Pineda ..... 248/104
7,287,474 B2 * 10/2007 Whitley ..... 102/358
7,387,288 B2 * 6/2008 Hull et al. ..... 249/91
2002/0194803 A1 * 12/2002 Mitchell ..... 52/297
2003/0029122 A1 2/2003 Ecker et al.
2004/0040247 A1 3/2004 Morse
2004/0088942 A1 5/2004 Trangsrud

FOREIGN PATENT DOCUMENTS

JP 01210554 A * 8/1989

* cited by examiner

DEVICE, SYSTEM, AND METHOD OF HOLDING REBAR IN A SUBSTANTIALLY FIXED POSITION IN A SURFACE

CROSS REFERENCE TO RELATED APPLICATIONS

This application is a divisional application of application Ser. No. 10/986,245 filed on Nov. 10, 2004 by Warren E. Parish now U.S. Pat. No. 7,549,261 which is incorporated by reference herein in its entirety.

BACKGROUND OF THE INVENTION

1. Field of the Invention

This invention relates to fasteners for reinforcing bars and more particularly relates to fasteners for holding reinforcing bars, such as rebar, in a fixed position.

2. Description of the Related Art

Reinforcing bar ("rebar") is typically placed in concrete structures, such as concrete foundation blocks and solid concrete stem walls, during construction to provide tensile strength and rigidity. This is accomplished by suspending rebar in coplanar grid-like patterns within forms before filling the forms with cement. In order to maintain a stationary rebar configuration as concrete is poured, it is common practice to force rebar into the ground to a predetermined depth to hold the rebar configuration in a particular position and subsequently manually bind reinforcing bars together with wire ties where they intersect. The wire ties roll, stretch, and vibrate loose when heavy machinery is used nearby.

When laying cement, it is critical that the proper vertical orientation of the reinforcing bars be maintained as cement is poured into the forms. In the past, wooden stakes were pounded into the ground and used as measurement tools for laying a particular grade of cement. Recent laws now prohibit the use of wood in cement because wood tends to rot and disintegrate, thus compromising the structural integrity of the cement structure. Consequently, workers began using rebar itself for laying cement at a fixed grade.

The rebar pieces are generally cut into short lengths and pounded into the ground in a vertical orientation and fixed pattern, usually in a line. Longer, horizontal rebar members are laid near the base of each vertical rebar piece and secured with tie wire, perpendicularly, approximately two inches from the ground. Additional horizontal pieces may be wired to the vertical members as needed, perhaps spaced two or more inches apart.

As discussed above, the tie wire rolls, stretches, and vibrates loose. Additionally, because the vertical rebar members have such a small diameter (usually between ½ inch to one inch), the vertical rebar member loosens from the ground also. Particularly, the vertical rebar member may be kicked, vibrated loose, or the ground or soil may be undesirably soft for the vertical member to stay secured in the ground. In rocky terrain, the vertical rebar member may fall into a void, thus causing all the horizontal members to fall also, ultimately causing the entire rebar structure to fall from the required specification.

After the rebar has been laid and the cement is being poured, workers often have difficulty finishing the cement and ensuring a proper grade. This is particularly true for large pads of cement. In practice, the area that is to receive the cement is usually cordoned off with wood, such as 2×4's or 2×6's. Cement is poured in the cordoned area, and long leveling boards, pipe, or other devices are used to ensure that the cement pad is flat and level with the surrounding wood. The cement pad is flattened and leveled by moving the leveling board, pipe, or other device in a sawing motion, or spinning, or vibrating the board or pipe across the wood border.

Many areas, however, may not be cordoned off with wood, rather the area to receive the concrete is between existing walls. In such situations, screeds are placed atop the vertical rebar pieces and a pipe is laid over the screeds. The concrete is poured over the screeds and the pipe. The area is flattened and leveled by moving the leveling board or the leveling pipe, or other device, over the pipe that has been laid over the screeds. Excess concrete is removed. For this reason, it is imperative that the vertical rebar stays at a fixed position in the ground. If the vertical rebar becomes loose, or falls into a void in the ground, the concrete will not be level and may therefore gather puddles, crack, and appear unsightly.

What is needed is a device, system, and method that securely holds the vertical rebar members in a fixed position in a surface.

BRIEF SUMMARY OF THE INVENTION

The present invention has been developed in response to the present state of the art, and in particular, in response to the problems and needs in the art that have not yet been fully solved by currently available reinforcing bar securing devices. Accordingly, the present invention has been developed to provide a device, system, and method for holding reinforcing bars in fixed positions that overcome many or all of the above-discussed shortcomings in the art.

To achieve the foregoing features, and in accordance with the invention as embodied and broadly described herein in the preferred embodiments, an improved reinforcing bar securing device comprises a base and a securing means for securing the reinforcing bar to the base, which is configured to engage at least one rib of the reinforcing bar.

The securing means is further configured, in one embodiment, with at least one flange protruding from the base to engage the rib. The flange may be configured to ramp up at an angle equal to an angle of the ribs of the reinforcing bar.

The securing means may include a hinged member, or a flexible member, such as plastic, for example, configured to allow the reinforcing bar to enter the securing means in one direction and engage at least one rib on the reinforcing bar to prevent the reinforcing bar from withdrawing from the securing means.

The flanges are configured to bend to press against, or pinch, the reinforcing bar as the ribs contact the flanges and as the reinforcing bar moves in an opposite direction with respect to the securing device as the reinforcing bar enters the surface. The reinforcing bar may be forced into dirt, rock, asphalt, concrete, wood, or gravel, and the securing device presses against those surfaces. In yet another embodiment, the flanges may be offset to match the ribs located on the reinforcing bar.

A system of the present invention is also presented for holding reinforcing bars in fixed positions. The system, in one embodiment, includes a first securing device for holding a first reinforcing bar in a fixed position in the surface and a second securing device for holding a second reinforcing bar at a predetermined position along the length of the first reinforcing bar. Each securing device of the system comprises a securing means configured to engage a rib of the first reinforcing bar.

A method of the present invention is also presented for securing a reinforcing bar into a surface. The method in the disclosed embodiments substantially includes the steps necessary to carry out the functions presented above with respect to the operation of the described device and system. In one embodiment, the method includes the steps of cutting a reinforcing bar to a predetermined length, attaching a securing device to the reinforcing bar at a predetermined position, and inserting the reinforcing bar into the surface until a bottom side of the securing device contacts the surface and prevents the reinforcing bar from entering further.

The method also may include a securing means for securing the reinforcing bar to the securing device and is configured to engage a rib of the reinforcing bar. The method may further include the step of attaching a second securing device to the reinforcing bar at a predetermined position to hold a second reinforcing bar.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1:
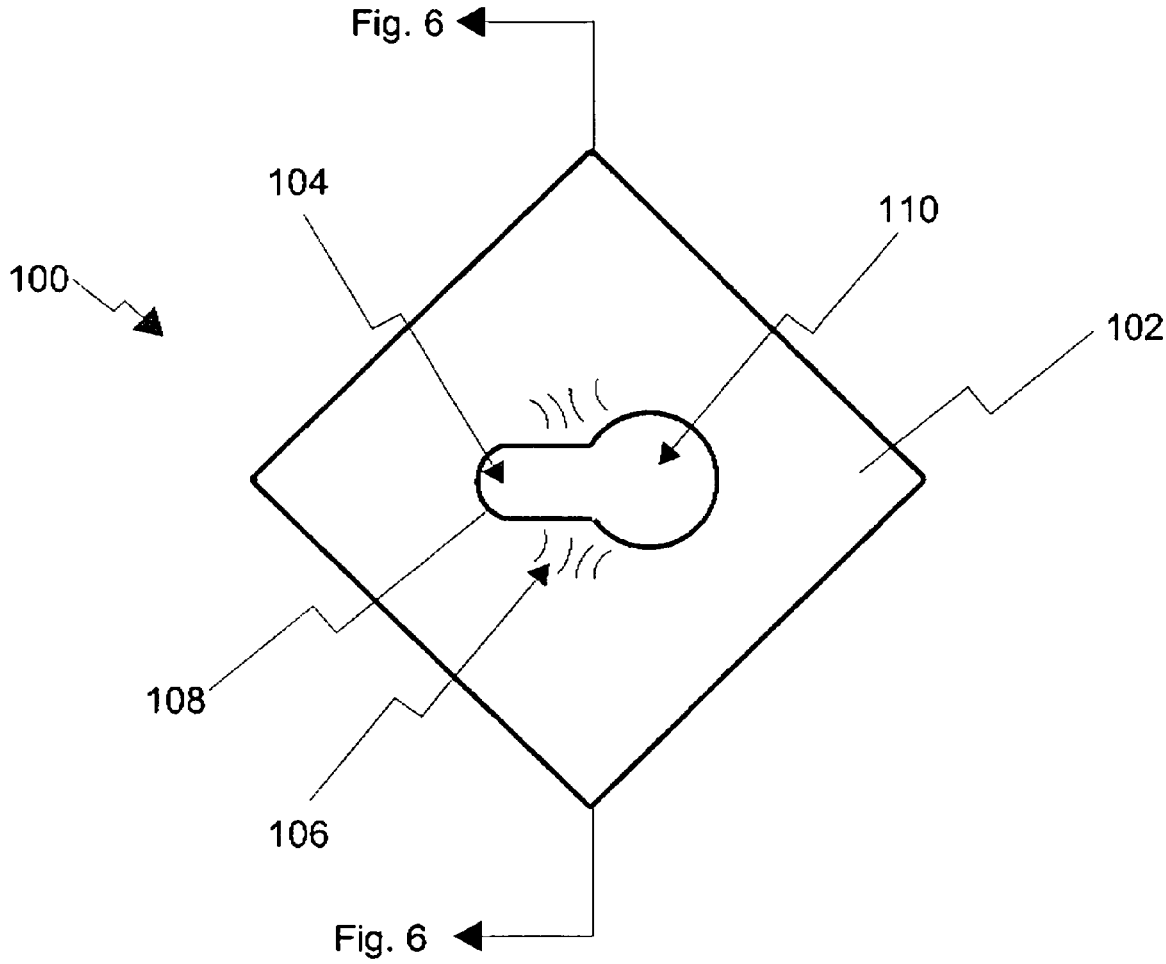
FIG. 1 is a top view illustrating one embodiment of a reinforcing bar washer in accordance with the present invention.
Figure 2:
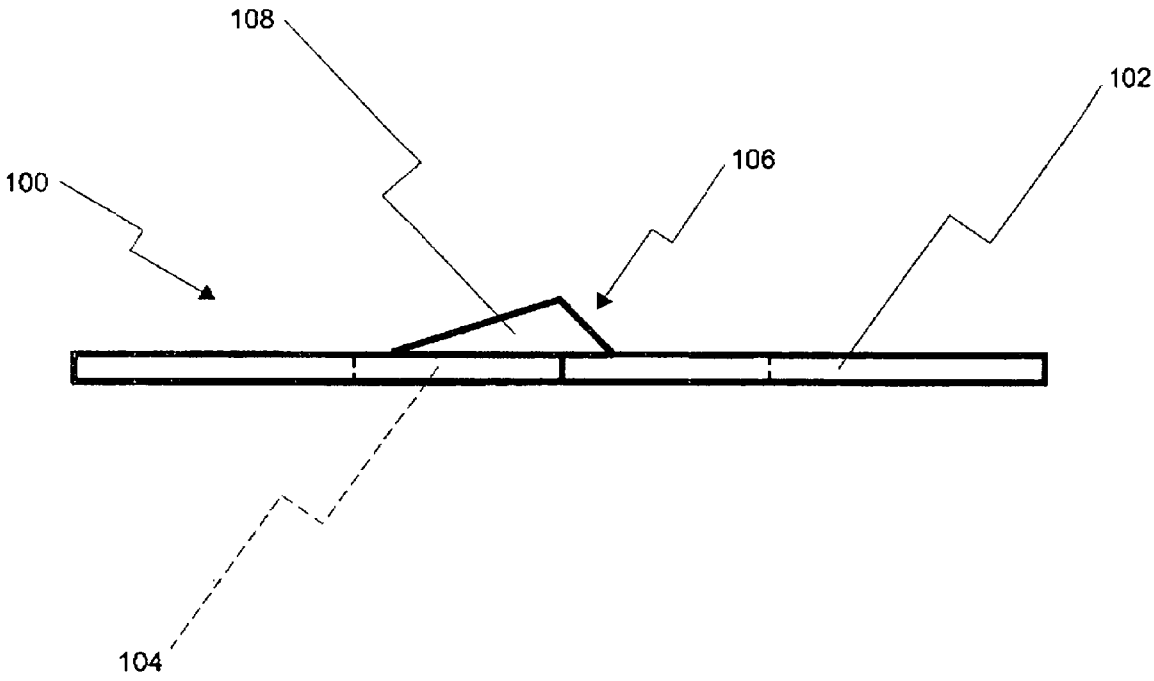
FIG. 2 is a side view illustrating one embodiment of a reinforcing bar washer in accordance with the present invention.

FIGS. 1 and 2 depict top and side views, respectively, of a reinforcing bar washer ("rebar washer"), or securing device, 100 in accordance with one embodiment of the present invention. The rebar washer 100 includes a base 102, a channel 104 passing through the base 102, and a securing means 106. The channel 104 is configured to receive a rebar 300 (See FIG. 3) and the securing means 106 is configured to removably secure the rebar 300 to the base 102. The rebar 300 enters the rebar washer 100 through a hole 110 in the base and is transferred to the channel 104 to removably secure the rebar washer 100 to the rebar 300 at a predetermined length.

In one embodiment, the securing means 106 comprises a plurality of flanges 108 protruding from the base 102. In one embodiment, the flanges 108 ramp up from the base 102 at one end of the channel 104 and towards the hole 110. The flanges 108 are configured to engage at least one rib, or flute, 302 (See FIG. 3) of the rebar 300. Preferably, the flanges 108 ramp up at an angle equal to an angle of the ribs 302 of the rebar 300. It is recognized that many rebar types exist and therefore, the exact angle of the rib 302 may vary. In many cases, the angle of the rib 302 ranges from approximately zero degrees to sixty degrees with respect to the base 102.

Figure 3:
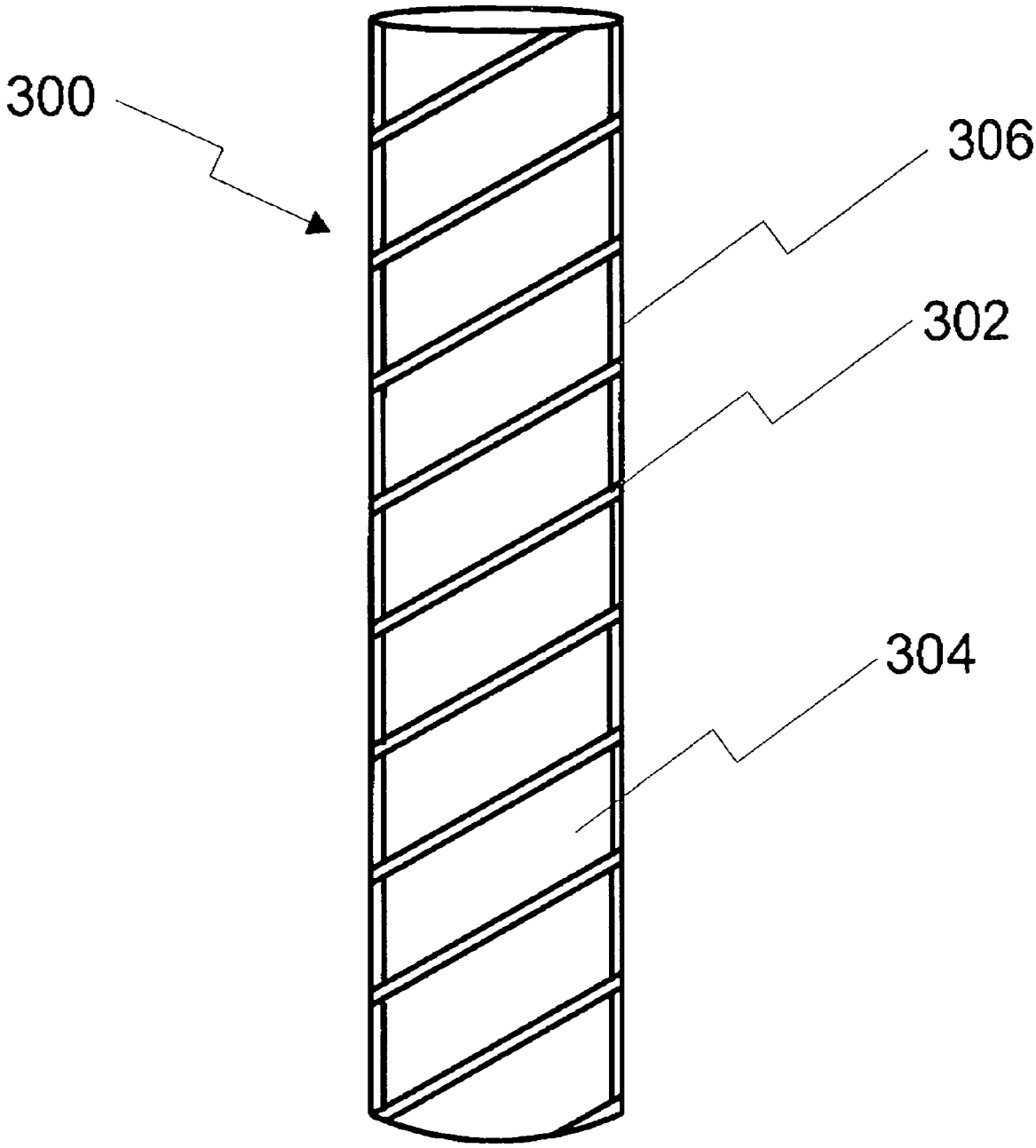
FIG. 3 is a front perspective view illustrating one embodiment of a typical reinforcing bar in accordance with the present invention.
Figure 4:
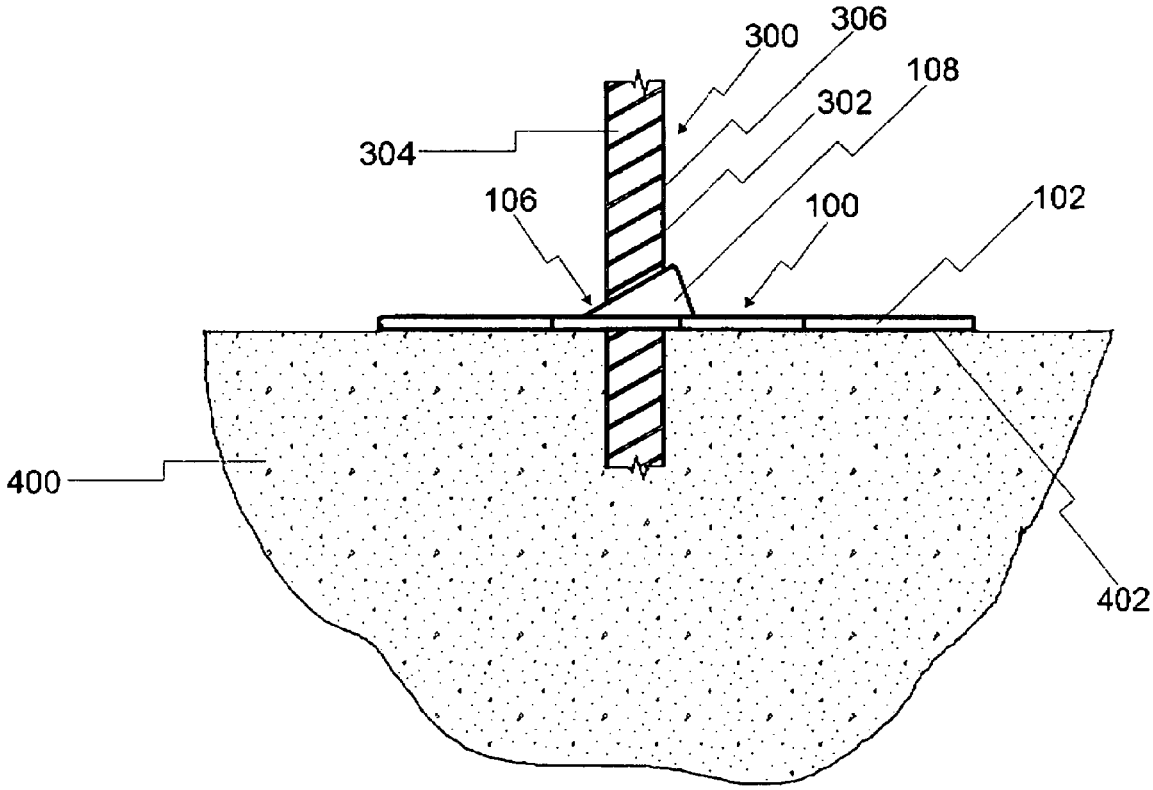
FIG. 4 is a side view illustrating one embodiment of a reinforcing bar and washer application in accordance with the present invention.
Figure 5:
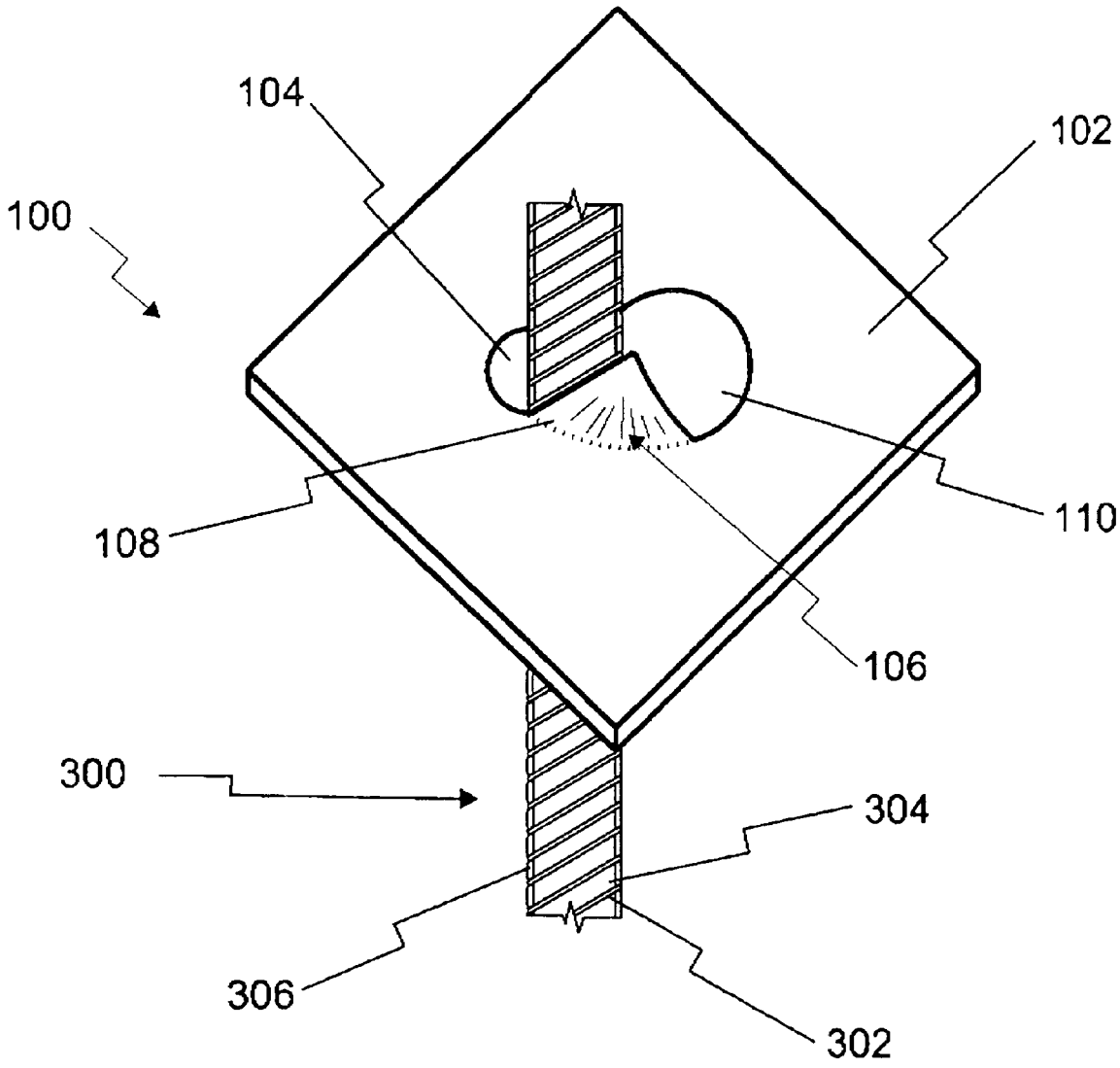
FIG. 5 is a side perspective view illustrating one embodiment of a reinforcing bar and washer configuration in accordance with the present invention.

FIGS. 3, 4, and 5 illustrate front and side perspective views of the rebar 300 and application with the rebar washer 100 in accordance with one embodiment of the present invention. The ribs 302 protrude from a rebar shaft 304. Most rebar 300 include a longitudinal rib 306 that connects the ribs 302 lengthwise.

Referring to FIGS. 4 and 5, in operation, the rebar 300 enters the base 102 through the hole 110. At a predetermined distance along the length of the rebar 300, the rebar 300 is transferred to the channel 104. The flanges 108 of the securing means 106 extend into the channel 104 to decrease the width of the channel 104. Preferably, the flanges 108 sufficiently extend into the channel 104 so as to create an area slightly larger than the diameter of the rebar shaft 304 to allow the rebar 300 to enter into the channel 104. It is noted, however, that the diameter of the rebar 300 including the ribs 302 is greater than the width of the channel 104 so that the ribs 302 act as stops to prevent the rebar 300 from significant longitudinal movement in the channel 104.

As the rebar 300 is forced into the ground 400, a counter force from the ground acts against the rebar washer 100 and pushes the flanges 108 against the ribs 302. Specifically, the flanges 108 engage the ribs 302 to prevent the rebar 300 from entering too far into the ground 400.

At the same time, a bottom surface 402 of the rebar washer 100 provides ample surface area to prevent the rebar 300 from entering further into the ground 400 than desired and serves to pack the ground to increase the ground's 400 hold on the rebar 300.

Figure 6:
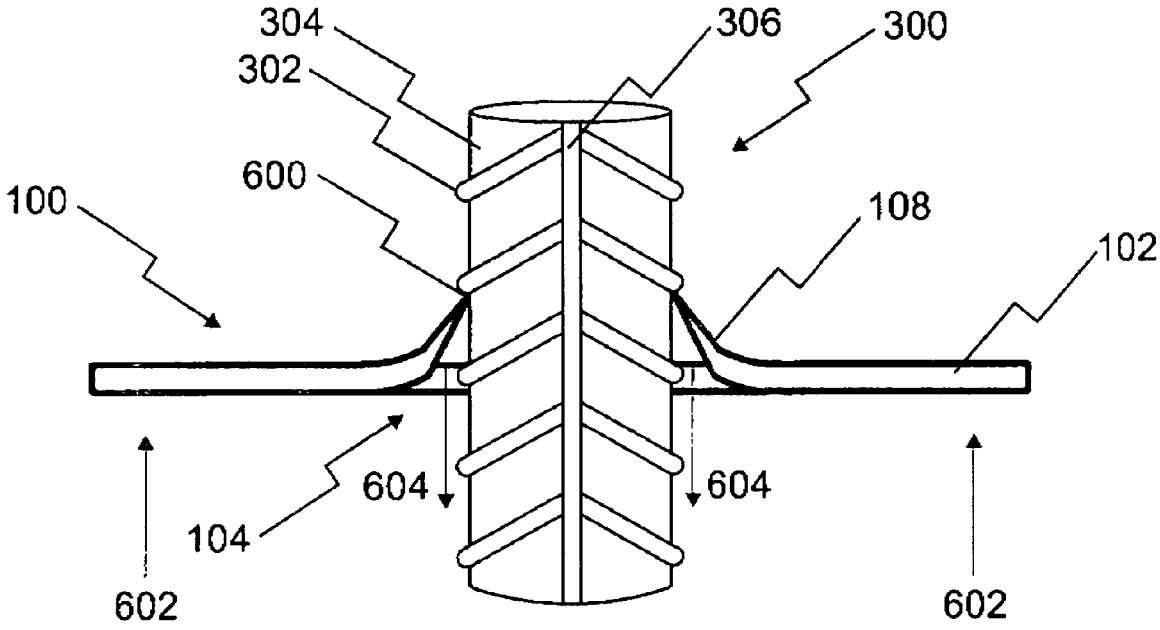
FIG. 6 is a side cross-sectional view illustrating one embodiment of a reinforcing bar washer in accordance with the present invention.

FIG. 6 illustrates a side cross-sectional view of a rebar washer 100 in accordance with one embodiment of the present invention. The flanges 108 extend into the channel 104 (See FIG. 1). Tips 600 of the flanges 108 are configured to engage the ribs 302 to prevent the rebar 300 from moving.

Preferably, the tips 600 are substantially pointed to provide the best possible grip on the ribs 302. It is noted that the flanges 108 are further configured to flex to increase grip on the ribs 302 and the rebar shaft 304. Specifically, as the rebar 300 is forced into the ground 400 (See FIG. 4), the counter forces acting in the direction of arrows 602 cause the flanges 108 to move in the direction of arrows 604. Ultimately, the flanges 108 press against the rebar shaft 304 and the tips engage the ribs 302, thus increasing the stability of the rebar 300 in a fixed position in the ground.

Figure 7:
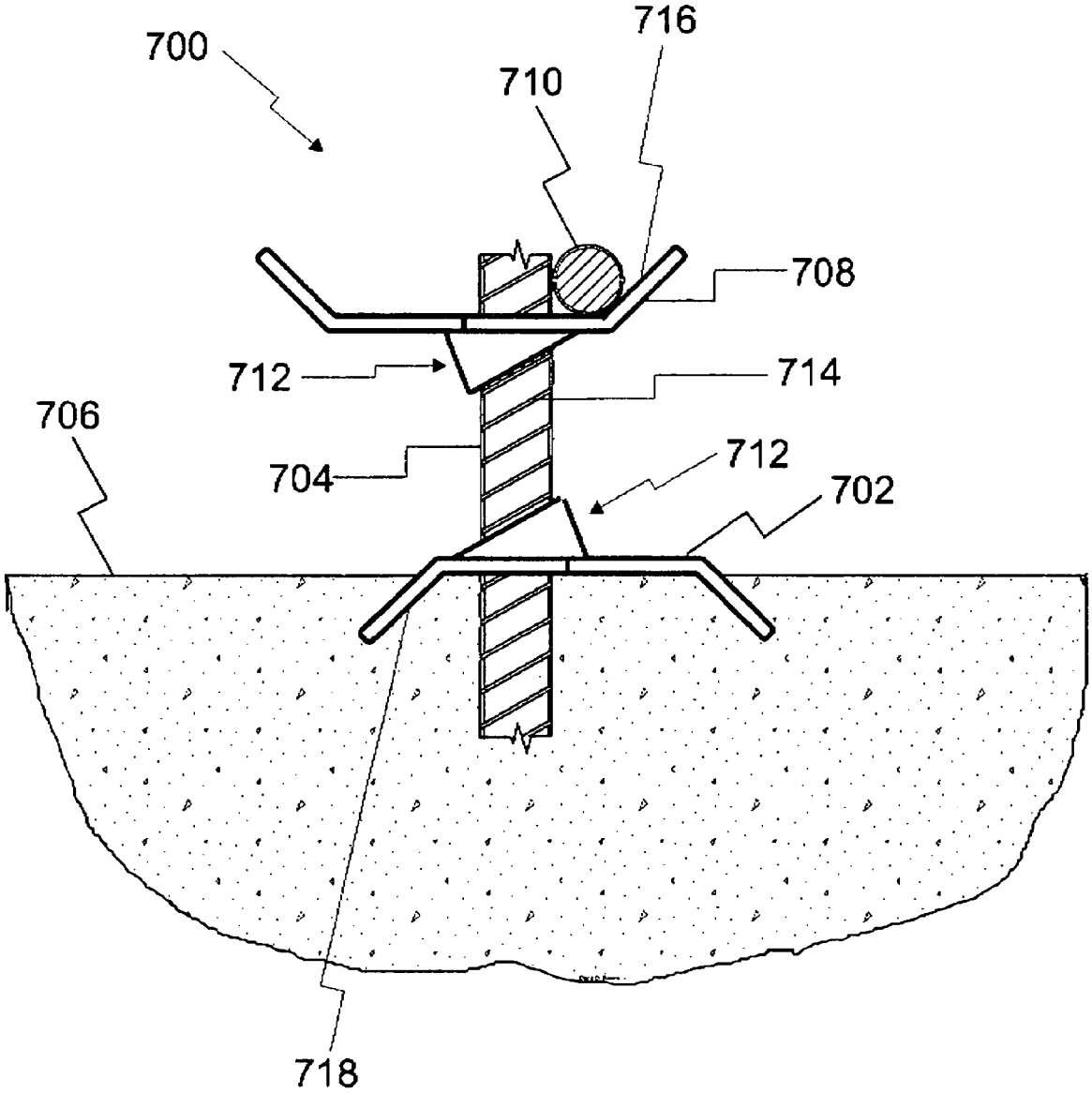
FIG. 7 is a side view illustrating an alternative embodiment of a reinforcing bar washer system in accordance with the present invention.

FIG. 7 is a side view illustrating an alternative embodiment of a rebar washer system 700 in accordance with the present invention. The rebar washer system 700 includes a first rebar washer 702 for securing a first rebar 704 to a surface 706, a second rebar washer 708 for holding a second rebar 710 at a predetermined position along a length of the first rebar 704. Each rebar washer 702 and 708 comprises a securing means 712 configured to engage a rib 714 of the first reinforcing bar 704. Both rebar washers 702 and 708 are configured to fit over the rebar 704 as discussed above in FIGS. 4 and 5. However, in this embodiment, the second rebar washer 708 is flipped over to prevent the rebar washer 708 from sliding down the rebar 704 due to a lack of counter force normally supplied from the surface 706.

The second rebar washer 708 includes at least one lip 716 configured to hold the second rebar 710 proximate to the first rebar 704. Advantageously, this provides support to the second rebar 710 to help eliminate the risk that the second rebar may loosen as a result of standard tie-wire techniques. In some circumstances, the user may be able to completely eliminate the need to tie-wire the second rebar 710 to the first rebar 704.

In the illustrated embodiment, the first rebar washer 702 includes an optional lip 718. The lip 718 provides additional stabilization to the first rebar 704 and acts to compress and compact the surface 706 to improve support around the first rebar 704.

Figure 8:
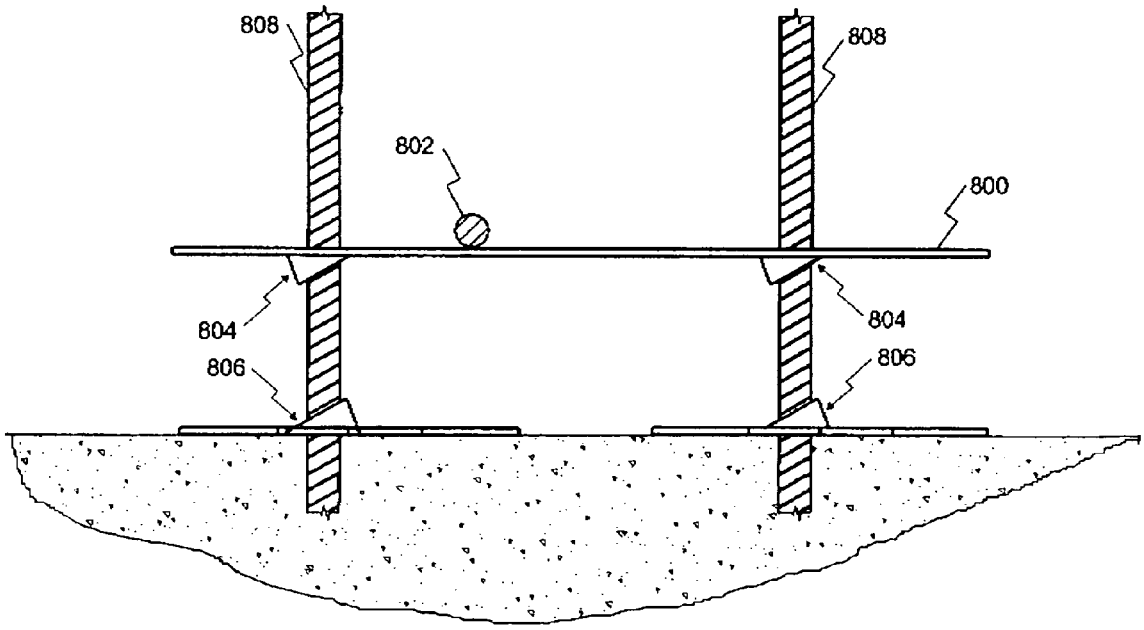
FIG. 8 illustrates another embodiment for using a rebar securing device to hold a second rebar in a stationary position.

FIG. 8 illustrates another embodiment for using a rebar securing device 800 to hold a second rebar 802 in a stationary position. The rebar securing device 800 comprises a plurality of securing means 804. First rebar securing devices 806 hold vertical rebar sections 808 in a fixed position in the ground, as described above. The rebar securing device 800 of the illustrated embodiment attaches to the vertical rebar sections 808 similar to the embodiments illustrated in FIG. 7. Particularly, the rebar securing device 800 is flipped over and attached to the vertical rebar sections 808. The second rebar 802 rests atop the rebar securing device 800. One skilled in the art will recognize that the rebar securing device 800 of the illustrated embodiment may comprise additional securing means 804, which may be extended for any preferred length and attach to any number of vertical rebar sections 808.

Figure 9:
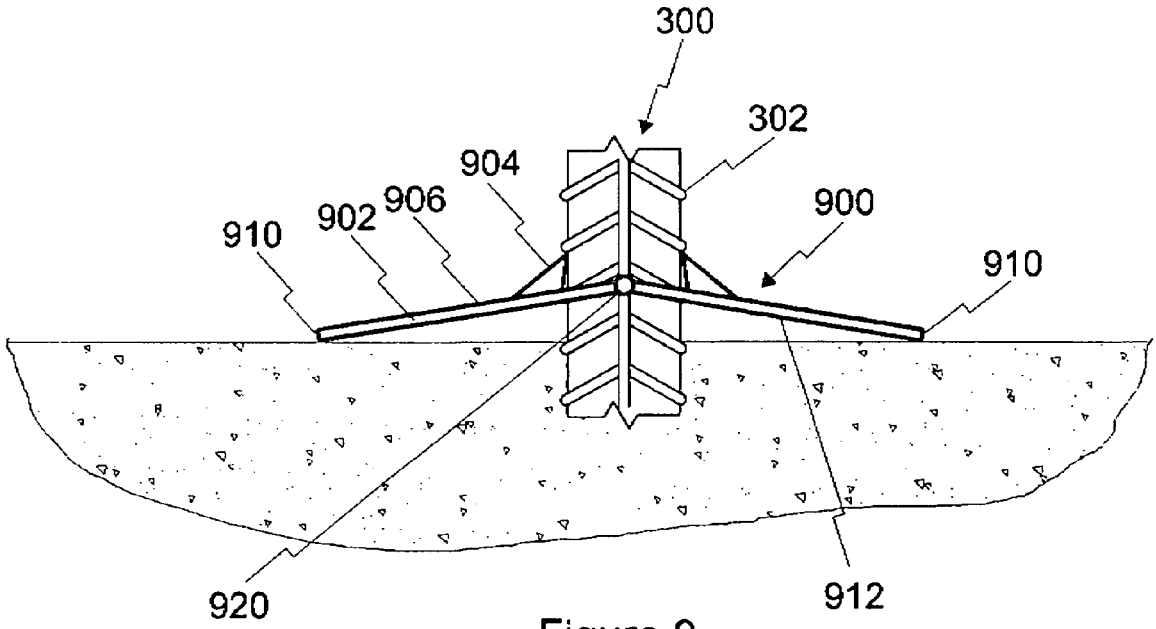
FIG. 9 illustrates a hinged rebar securing device according to one embodiment of the present invention.

FIG. 9 illustrates a hinged rebar securing device 900 according to one embodiment of the present invention. The hinged rebar securing device 900 comprises a base 902 with a hinge 920 functionally coupling the base 902 together. A securing means 904 protrudes from an upper surface 906 of the base 902 and is configured to engage at least one rib 302 of the rebar 300.

In operation, a piece of rebar 300 is inserted into a hole (not shown) in the base 902. The hinged rebar securing device 900 is adjusted to a certain height along the rebar 300. As the user inserts the rebar 300 into the ground, the ground pushes against distal ends 910 of the bottom surface 912 of the base 902. As the ground pushes against the distal ends 910, the hinge 920 allows the base 902 to rotate such that the securing means 904 begins to engage the ribs 302 of the rebar 300. As the base 902 flattens, the securing means 904 tightens around the rebar 300 and increases pressure on the ribs 302.

Advantageously, as pressure against the rebar 300 increases to insert the rebar 300 into the ground, the amount of force that is applied to the rebar 300 increases also. Consequently, the rebar 300 remains in a generally stationary position in the ground.

Figure 10:
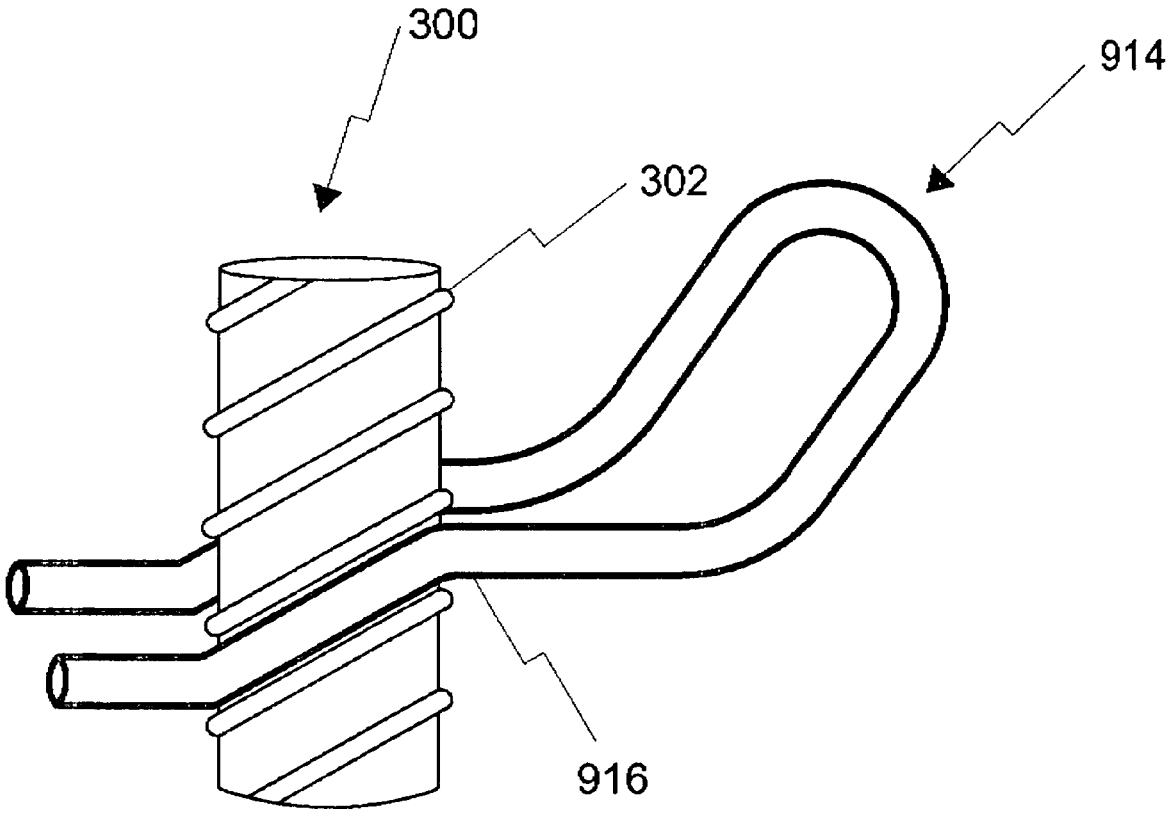
FIG. 10 illustrates a clip style rebar securing device according to one embodiment of the present invention.

FIG. 10 illustrates a clip style rebar securing device 914. The clip style rebar securing device 914 comprises a clip configured to slide between ribs 302 of the rebar 300. Arms 916 of the clip should match the angle of the flanges 108 that they engage. In some embodiments, the arms 916 may be slightly slanted, between 0 and 60 degrees, or more, to match the angle of the ribs 302. Just as the rebar securing devices of previous embodiments, the clip style rebar securing device 914 prevents the rebar 300 from entering too far into the ground and holds the rebar 300 in a generally stationary position.

Figure 11:
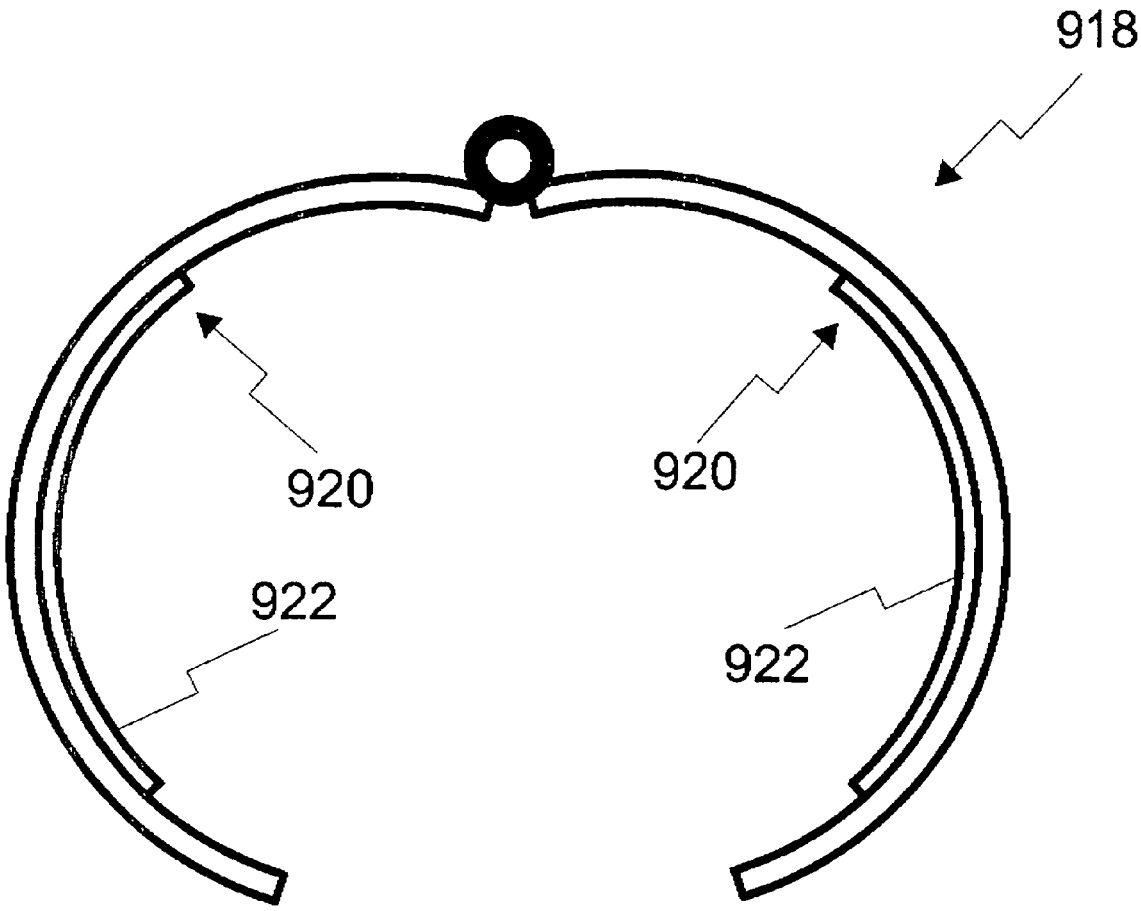
FIG. 11 illustrates a clamping style securing device according to one embodiment of the present invention.

FIG. 11 illustrates a clamping style securing device 918 according to one embodiment of the present invention. Inner surfaces 920 of the clamping style securing device 918 include grooves 922 configured to grab the ribs 302 (See FIG. 3). The clamping style securing device 918 is configured to envelope a section of the rebar 300 (See FIG. 3) and grip the ribs 302 to hold the rebar 300 in a stationary position. The clamping style securing device 918 may further comprise a locking mechanism (not shown) to hold the clamping style securing device 918 in a locked position. It is envisioned that the locking mechanism may be a zip tie, a hook, clasp, clip, or other locking device well known in the art.

It is understood that the above-described arrangements are only illustrative of the application of the principles of the presently illustrated invention. The present invention may, however, be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the specification discusses the use of flanges 108 for engaging the ribs 302 to hold the rebar 300 in a substantially fixed position in the ground 400, it is envisioned that any type of securing means 106 could be employed. Specifically, it is envisioned that the securing means 106 may comprise a hinge type device that folds, or flaps, about the base 102 to catch the ribs 302. Other securing means, such as clasps, screws, bolts, pins, compliant mechanisms, and one-way flexible rebar valves may be used.

The ribs 302 illustrated in FIG. 6 are symmetrically matched to engage the tips 600 at substantially the same time. It is noted, however, that the ribs 302 may be offset due to manufacturing methods and preferences. Accordingly, it is envisioned that the flanges 108 may also be offset in a fashion to mirror the offset ribs 302 such that the flanges 108 are configured to engage the ribs 302 at substantially the same time.

It is further envisioned that the rebar washers 100 may be made of any type of strong and durable material, such as plastic, metal, rubber, etc. The rebar washers 100 may be manufactured using a press, cast, injection molded, or any other known manufacturing process.

Although the specification teaches that the reinforcing bar is forced into the surface, it is envisioned that the reinforcing bar may be pressed, hammered, buried, pounded, or inserted into the surface by any type of manual, mechanical, or physical means or device well known in the industry.

Although the specification teaches that the rebar washer 100 is attached to the reinforcing bar and subsequently forced into the surface, it is envisioned that the reinforcing bar may be forced into the surface and subsequently receive the rebar washer 100.

Although the specification discusses the use of a single securing means 106 attached to the base 102, it is envisioned that a single base 102 may include a plurality of securing means 106, which may be used to hold more than one rebar 300 in a particular position, or it may be used to suspend additional rebar 300 pieces about other rebar 300.

Although the specification discusses using the securing device 100 or system in the ground 400, it is also envisioned that the securing device 100 or system may be used to hold the rebar 300 in a fixed position over soft surfaces, such as mud or freshly poured concrete. This is possible due to the large surface area of the bottom side of the base 102. Naturally, securing devices 100 may be manufactured with larger surface areas than those shown in the illustrated examples.

Although the specification shows that the rebar includes ribs 302 that angle approximately thirty degrees, it is envisioned that the ribs 302 may be any angle that the rebar manufacturer intends.

Finally, although the specification discusses, and the figures illustrate, the use of round rebar, it is envisioned that the rebar washers may be configured to receive rebar of any shape.

Thus, while the present invention has been fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A method of holding a reinforcing bar in a substantially fixed position in a surface comprising the steps of:

providing a reinforcing bar;

attaching a securing device to the reinforcing bar at a predetermined position, wherein the securing device includes a securing means for holding the reinforcing bar in a substantially fixed position, the securing means configured to engage a rib of the reinforcing bar; wherein the securing device includes a base having a hole therethrough; wherein the securing means is attached to the base and includes a channel in communication with the such that the reinforcing bar may be slid from the hole to the channel, wherein the channel is more narrow than the hole, such that the channel may engage with at least one rib; wherein the channel is defined by a pair of contrapositioned flanges protruding from the base in a ramping configuration such that a least ramped portion of the contrapositioned flanges is disposed opposite the hole and a most ramped portion of the contrapositioned flanges is disposed adjacent the hole;

inserting the reinforcing bar into the surface until a bottom side of the securing device contacts the surface and prevents the reinforcing bar from entering further into the surface.

2. The method according to claim 1, wherein the flange ramps up at an angle between 0 and 60 degrees with respect to the base.

3. The method according to claim 1, wherein the flanges ramp up at an angle equal to an angle of the rib of the reinforcing bar with respect to the base.

4. The method according to claim 1, wherein the securing means is a flexible material configured to flex to allow the reinforcing bar to enter the securing means in one direction and configured to engage at least one rib on the reinforcing bar to prevent the reinforcing bar from withdrawing from the securing means.

5. The method according to claim 4, wherein the securing means is made of a material selected from the group consisting of plastic, rubber, ceramic, composite, and metal.

6. The method according to claim 1, wherein the flanges are configured to bend to press against the reinforcing bar as the ribs contact the flanges and as the reinforcing bar moves in an opposite direction with respect to the securing device.

* * * * *